US006016681A

United States Patent [19]

Kenning

[11] Patent Number: 6,016,681

[45] Date of Patent: Jan. 25, 2000

[54] BULLET TUBE EXPANDING APPARATUS

[75] Inventor: Daniel William Kenning, Chelmsford, United Kingdom

[73] Assignee: Ford Motor Company, Dearborn, Mich.

[21] Appl. No.: 09/138,263

[22] Filed: Aug. 21, 1998

[30] Foreign Application Priority Data

Aug. 23, 1997 [GB] United Kingdom ..... 9717895

[51] Int. Cl.[7] ..... B21D 39/20

[52] U.S. Cl. ..... 72/393; 72/478

[58] Field of Search ..... 72/370.05, 392, 72/393, 478, 480; 29/727

[56] References Cited

U.S. PATENT DOCUMENTS

| | | | |
|---|---|---|---|
| 3,358,492 | 12/1967 | Richter | 72/478 |
| 3,901,063 | 8/1975 | Nileshwar | 72/478 |
| 4,262,518 | 4/1981 | Creger et al. | 72/393 |
| 5,685,066 | 11/1997 | Mohrmann et al. . | |

*Primary Examiner*—Lowell A. Larson

*Attorney, Agent, or Firm*—Raymond L. Coppiellie

[57] ABSTRACT

An apparatus for expanding a tube 1 from a first diameter $d_1$to a second diameter $d_2$ by passing a mandrel through a tube 1 includes a bullet assembly 3 comprising at least two co-operating bullet segments 5, 7, 9, Each of the bullet segments 5, 7, 9 has an outer surface 11 for contacting the inner surface of the tube and an inner surface 13 for contacting the inner surface of an adjacent bullet segment. The outer surface 11 of each segment is generally arcuate in radial cross-section and each segment has a body region 15 between a head 17 and tail region 19. The inner surfaces 13 of adjacent bullet segments 5, 7, 9 have co-operating tapered surfaces 21 shaped such that the bullet segments are movable axially with respect to one another such that the bullet assembly 3 may be in an expanded state or a collapsed state. The apparatus also includes a device 23 to axially slide the bullet segments one with respect to another so that as the bullet assembly is pushed into the tube, the bullet segments are in a collapsed state and as the bullet assembly 3 is pulled out of the tube the bullet segment are slid axially one with respect to another into their expanded state to expand the tube diameter from a first diameter to the second diameter $d_2$.

6 Claims, 5 Drawing Sheets

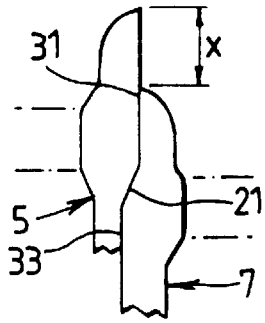
FIG.3A
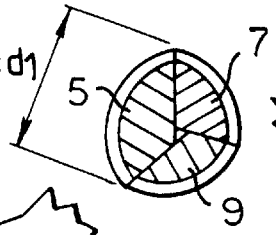
FIG.3D
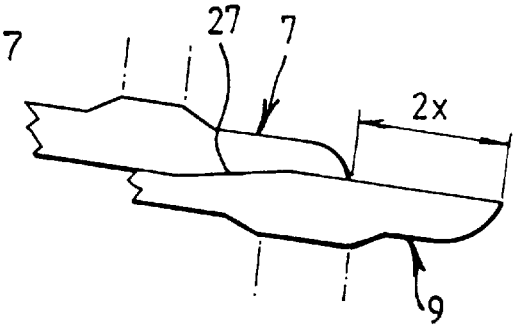
FIG.3B
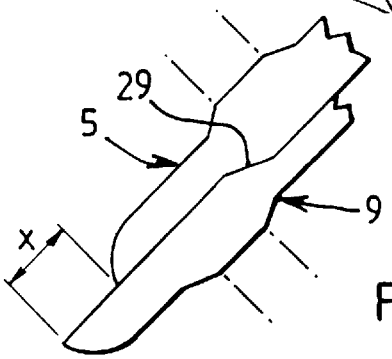
FIG.3C
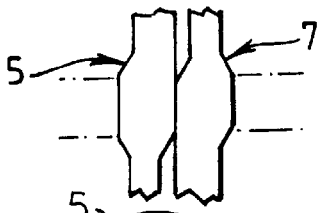
FIG.4A
FIG.4D
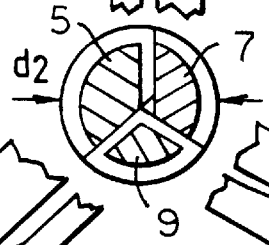
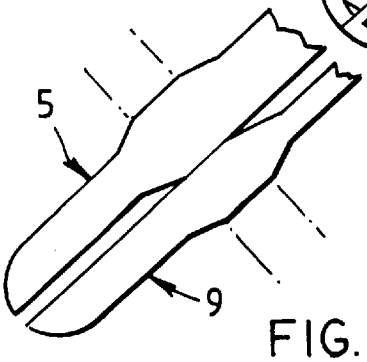
FIG.4C
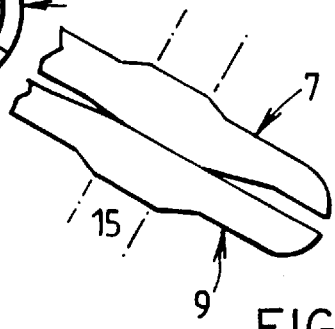
FIG.4B

BULLET TUBE EXPANDING APPARATUS

BACKGROUND OF THE INVENTION

1. Field of the Invention

The present invention relates to an improved bullet tube expanding apparatus and an improved bullet assembly for use in such an apparatus.

2. Disclosure Information

A bullet tube expanding apparatus is a well known apparatus which has been developed for expanding tubes by passing a mandrel or bullet mounted upon an elongate stem down the tube through the tube to expand the diameter. The diameter of the bullet is large enough to mechanically expand the tube beyond its elastic limit so that it retains the larger expanded diameter. The typical use is for expanding tubes to be secured to fins and end sheets to form heat exchangers.

In such an application a bank of bullets is passed through the tubes of a loosely assembled heat exchanger matrix until the whole length of the each tube is expanded causing an interference fit between the outsides of the tubes and the insides of the apertures of the fins. Typically the diameter of each such tube will be in the region of 6 mm to 8 mm.

The tool which is passed through the tubes is typically of steel and is known as the bullet. In the majority of applications the bullet expands the tube when it is pushed into the tube and the stem of the bullet is in compression. This means that there can be risk of buckling under load.

SUMMARY OF THE INVENTION

According to the invention, an apparatus for expanding a tube from a first diameter to a second diameter by passing a mandrel through a tube includes a bullet assembly comprising at least two co-operating bullet segments, each bullet segment having an outer surface for contacting the inner surface of the tube and an inner surface for contacting the inner surface of an adjacent bullet segment. The outer surface of each segment is generally arcuate in radial cross-section and each segment has a body region between a head and tail region. Each of the head and tail regions are of smaller cross-section than the cross-section of the body region. The inner surfaces of adjacent bullet segments have co-operating tapered surfaces shaped such that the bullet segments are movable axially with respect to one another such that the bullet assembly may be in an expanded state or a collapsed state. In the expanded state, the bullet segments lay with their body regions aligned, the body regions together defining a circle of diameter equal to the second diameter, and in a collapsed state, the body regions of the bullet segments are non-aligned whereby the diameter of the bullet assembly throughout its length is less than the first diameter. The apparatus of the present invention further includes means for axially sliding the bullet segments one with respect to another, such that as the bullet assembly is pushed into the tube, the bullet segments are in a collapsed state and as the bullet assembly is pulled out of the tube the bullet segment are slid axially one with respect to another into their expanded state such that pulling the bullet assembly through the tube expands its diameter to the second diameter.

In this way the expansion occurs when the bullet stems are in tension and there is therefore no risk of buckling so a support structure is not required. Also there is only a friction force on the bullet on one stroke instead of two strokes which allows for shorter cycle times and lower piece cost.

Preferably the apparatus includes a plurality of bullet assemblies arranged to expand a plurality of parallel tubes simultaneously, typically tubes of a heat exchanger.

Preferably the heads of the bullet segments are rounded and smooth and each bullet segment has a substantially identical outer surface to the other bullet segments. Clearly the inner surfaces cannot be identical to allow the relative movement between the segments into an expanded or collapsed condition.

It has been found that the use of three bullet segments is particularly advantageous since this provides a simple assembly that allows the bullet segments to be shaped such that when their body regions are aligned the outer surface of the bullet segment cover the entire circumference of a circle of second diameter, and the segments together at that point extend over the whole cross-section of the circle. The use of two bullet segments provides a cheaper construction, and allows the segments to be identical. However the cross section of the bullet assembly at the body region in its expanded position does not expand to a full circumference at $d_2$, otherwise the bullet assembly would interfere with the tube during insertion.

Preferably the means to move the bullet segments axially with respect to each other includes a plurality of pressure bearing plates, each plate being secured to a remote end of the stem of a bullet segment so that the plate lies substantially perpendicular to the stem. The bearing plates are mounted within a housing including a series of shoulders arranged such that when pressure is applied to the housing to push the assembly and the bullet assembly in a direction into the tube the plates are kept apart to collapse the bullet and when the housing is moved in an opposite direction and the bullet is pulled the plates are moved together thus axially moving the bullet segments with respect to one another to move the bullet assembly into its expanded state.

This arrangement of plates within a housing can be readily used with a plurality of bullet assemblies with a bullet segment from each assembly being secured to each bearing plate.

According to a further embodiment of the invention there is provided a bullet assembly for use in a bullet tube expander. The bullet assembly comprises at least two co-operating bullet segments, each bullet segment having an outer surface for contacting the inner surface of the tube and an inner surface for contacting the inner surface of an adjacent bullet segment. The outer surface of each segment is generally arcuate in radial cross-section and each segment has a body region between a head and tail region, each of the head and tail regions being of smaller cross-section than the cross-section of the body region. The inner surfaces of adjacent bullet segments have co-operating tapered surfaces shaped such that the bullet segments are movable axially with respect to one another such that the bullet assembly may be in an expanded state or a collapsed state. In the expanded state, the bullet segments lie with their body regions aligned, the body regions together defining a circle, and in a collapsed state the body regions of the bullet segments are non-aligned whereby the diameter of the bullet assembly throughout its length is less than the diameter of the circle defined by the body regions when they are aligned.

The material of the bullet segments may be steel throughout but it has been found that a steel/ceramic construction can give the strength required for the repeated pushing and pulling movement of the bullets and stems whilst in the region of the body where the outer surface of the bullet segments bear against the tube a ceramic insert can help reduce and withstand friction. Moreover if this ceramic insert extends to at least the co-operating tapered regions of the inner surface, friction between the segments can be reduced.

BRIEF DESCRIPTION OF THE DRAWINGS

An improved bullet tube expanding apparatus and three bullet assemblies will now be described, by way of example only, with reference to the accompanying drawings, in which:

FIGS. 3A–C show axial sectional views of the bullet assembly of FIG. 1. FIG. 3D shows a cross-sectional view taken along line 3—3 of FIG. 1.

FIGS. 4A–C show axial sectional views of the bullet assembly of FIG. 2. FIG. 4D shows a cross-sectional view taken along line 4—4 of FIG. 2.

DETAILED DESCRIPTION OF THE PREFERRED EMBODIMENTS

Figure 1:
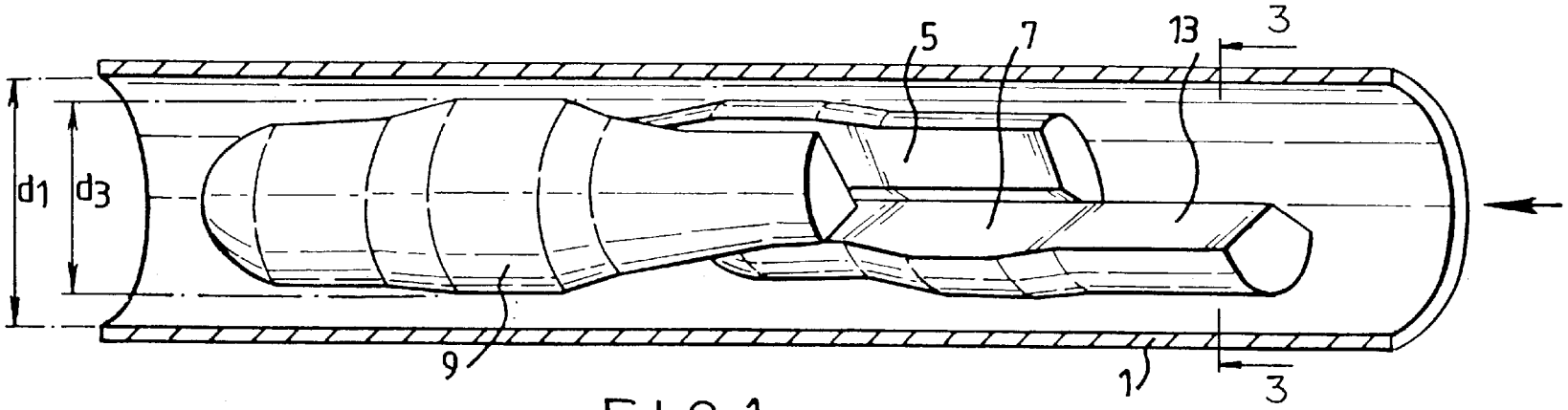
FIG. 1 is a schematic perspective view of a first bullet assembly in a collapsed state within a tube.
Figure 2:
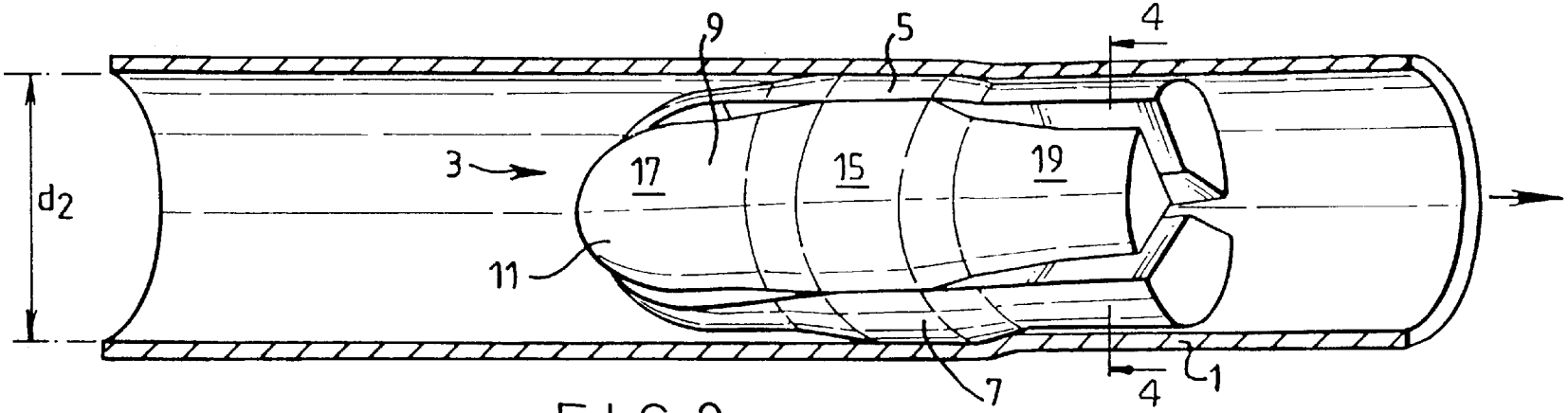
FIG. 2 is a schematic perspective view of the first bullet assembly in an expanded state within the tube.

An apparatus for expanding a tube 1 from a first diameter $d_1$to a second diameter $d_2$ by passing a mandrel through a tube 1 includes a bullet assembly 3 comprising at least two co-operating bullet segments 5, 7, 9, each bullet segment 5, 7, 9 having an outer surface 11 for contacting the inner surface of the tube and an inner surface 13 for contacting the inner surface of an adjacent bullet segment. The outer surface 11 of each segment is generally arcuate in radial cross-section and each segment has a body region 15 between a head 17 and tail region 19. Each of the head 17 and tail 19 regions are of smaller cross-section than the cross-section of the body region 15. The inner surfaces 13 of adjacent bullet segments 5, 7, 9 have co-operating tapered surfaces 21 shaped such that the bullet segments are movable axially with respect to one another such that the bullet assembly 3 may be in an expanded state or a collapsed state. In the expanded state, the bullet segments lie with their body regions 15 aligned, the body regions together defining a circle of diameter equal to the second diameter $d_2$. In a collapsed state, the body regions of the bullet segments are non-aligned such that the diameter of the bullet assembly $d_3$ throughout its length is less than the first diameter $d_1$. The present invention also include means 23 for axially sliding the bullet segments one with respect to another which will be described below. As the bullet assembly is pushed into the tube, the bullet segments are in a collapsed state and as the bullet assembly 3 is pulled out of the tube, the bullet segments are slid axially one with respect to another into their expanded state such that pulling the bullet assembly 3 through the tube expands its diameter to the second diameter $d_2$.

In a first embodiment, the bullet assembly 3 comprises three bullet segments 5, 7 and 9 which can be clearly seen in FIGS. 1 to 4. As can be seen the bullet segments have similar outer surfaces with a smooth rounded head region 17, a body region 15 of larger cross section and a tail region 19 which is extends into stem 25 (shown in FIGS. 5 to 7)

The inner surfaces 13 of the segments are not the same as can be seen in FIGS. 3 and 4. Each pair of adjacent segments has a co-operating taper 21 which allows the segments to nest into each other when those tapers are aligned. As can be seen in FIG. 3, the taper 21 between segments 5 and 7 is at a different position to the taper 27 between segments 7 and 9, and taper 29 between segments 5 and 9. The taper of each inner surface lies between a first head surface 31 substantially parallel to the tube axis and a tail surface 33 which lies substantially parallel to the tube axis.

In this way the tapers define the limit point of the respective axial sliding permitted for the bullet segments and when the respective tapers lie against each other the bullet assembly 3 is in its fully collapsed state. In this position the head of segment 9 leads the head of segment 5 by a distance x, which leads the head of segment 7 by a distance x.

In this position, the body region 15 of each segment lies adjacent the head or tail of each adjacent segment so that the total cross section of the body assembly 3 throughout its length would lie within a circle of diameter $d_3$ which is less than the diameter $d_1$of the tube 1.

However if the heads 17 of the segments are aligned as shown in FIG. 4 the body regions 15 are aligned so that the diameter of the body assembly at that region is equal to $d_2$ which is greater than the tubes original diameter $d_1$and therefore causes the tube to expand when the bullet is pulled through it.

The segments at the body region each have a cross section of a third of a circle of diameter $d_2$ which provides a solid at that point forcing against the inner surface of the tube.

The means to move the bullet assembly comprises a housing 35 which is mounted within the apparatus for axial movement with respect to the tube or tubes to be expanded by the apparatus. This part of the apparatus is conventional and is therefore not shown in the drawings nor described in any detail.

The housing 35 houses a series of pressure bearing plates 37, 39 and 41. Each bearing plate includes a bore 43 through which the stems of the bullet segments may pass and a has a locking plate 45 used to secure one of the stems to the bearing plate. The stem of each bullet segment tapers from the tail region of the bullet segment to an elongate length 47 of triangular cross section. At its end remote from the bullet area the end of the stem expands to describe a third sector 49 of a circle. A notch 51 is cut into each stem to allow it to slide into position on the locking plate.

This allows for easy assembly of the bearing plate 37 to the stem. As an example the stem of the bullet segment 7 is passed through the bore 43 passing through the bearing plate 37 and locking plate 45. Locking plate is moved in a direction opposite to the arrow shown in section A of FIG. 6 so that the notch 51 is secured over the locking plate edge and the plate 45 is secured into position by locking screw 53. Each other stem is assembled in a similar fashion. The arrows shown in FIG. 6 illustrate the direction of movement of the respective locking plate to allow disassembly of that stem.

The housing 35 defines a stepped space within of three differing cross sectional areas. Between the areas are shoulders 55, 57 and 59. The cross section of bearing plates 37, 39 and 41 are graduated so that bearing plate 41 fits within the space defined between shoulder 55 and the lower wall 61, bearing plate 39 is smaller so that it may fit in the space defined between shoulder 57 and the lower wall 61, and bearing plate 37 is smaller again so that it may fit in the space defined between shoulder 59 and the lower wall 61.

Figure 5:
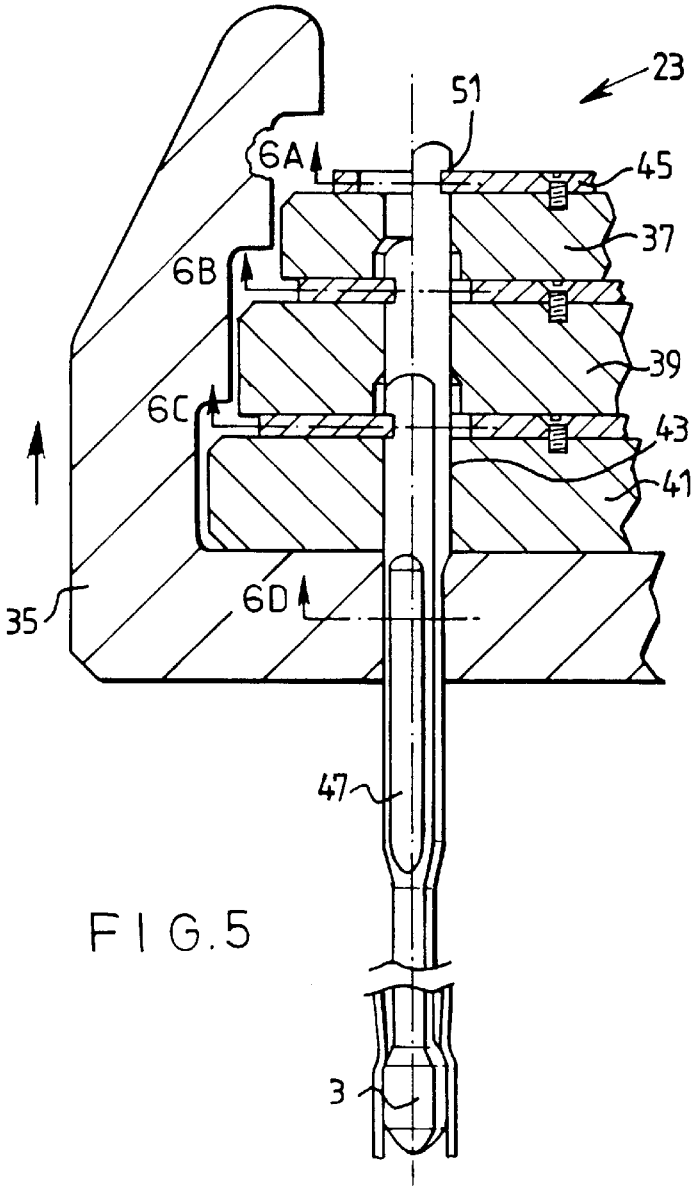
FIG. 5 is a section through part of the apparatus showing the first bullet being pulled through a tube.
Figure 6A:
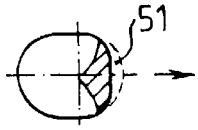
FIGS. 6A–D show cross-sectional views of the bullet of the present invention taken at lines A; B; C; and D, respectively, of FIG. 5.
Figure 6B:
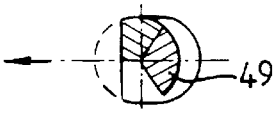
Figure 6C:
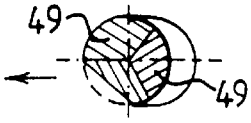
Figure 6D:
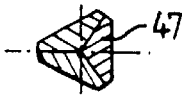

When the housing is moved in the direction shown in FIG. 5, pulling the bullet assembly through the tube, the lower wall 61 of the housing 35 moves upwards until it contacts the lower surface of the bearing plate 41 which is pulled upwards to contact the adjacent bearing plate until the plates lie in contact with each other. In this position the body regions 15 of the bullet segments are aligned and the bullet expands the tube.

Figure 7:
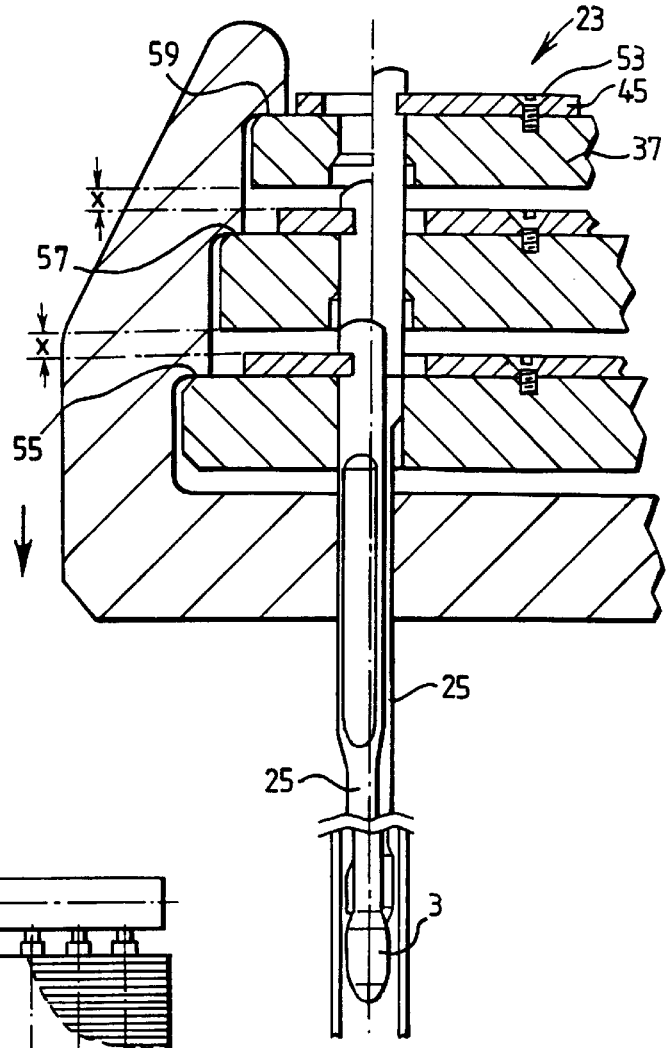
FIG. 7 is a section through the same part of the apparatus shown in FIG. 5 with the bullet being pushed through a tube.

When the housing 35 is moved in the opposite direction as shown in FIG. 7, the housing 35 moves down until the shoulders 55, 57 and 59 respectively contact bearing plates 41, 39 and 37 so that they are moved apart from one another. This moves the bullet segments 5, 7 and 9 axially with respect to one another so that they move into their collapsed state. The distance between the shoulders is chosen such that in the pushing direction the distance between each pair of bearing plates is equal to x.

Figure 8:
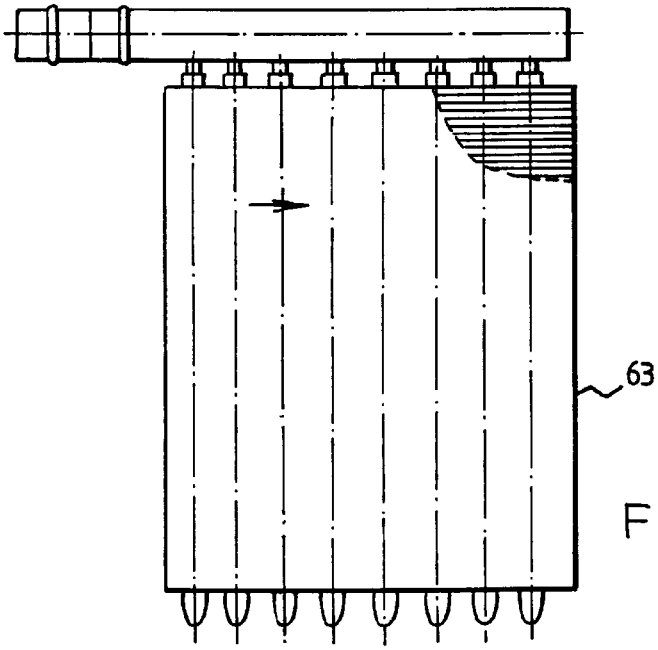
FIG. 8 is a front elevation of a typical heat exchanger.
Figure 9:
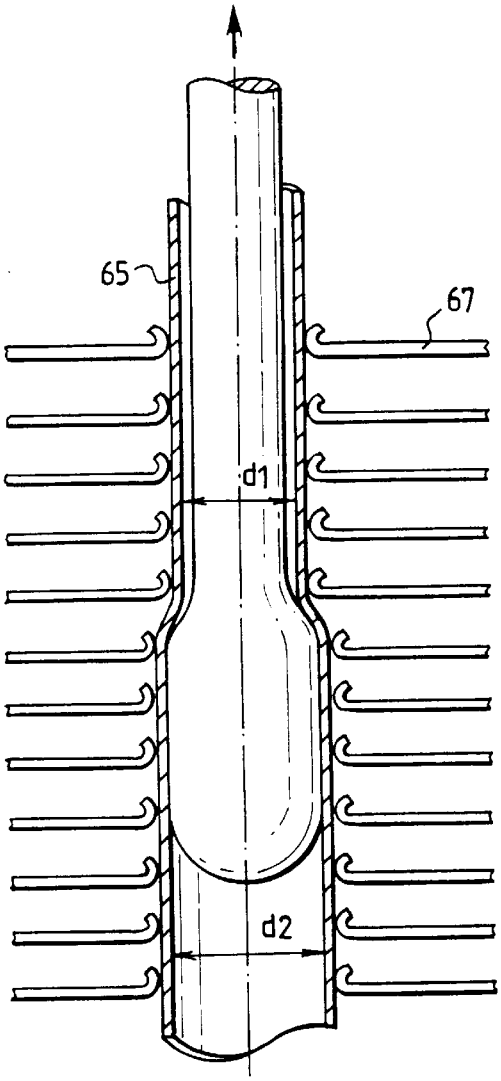
FIG. 9 is an enlarged part section through the heat exchanger of FIG. 8 schematically illustrating the bullet assembly being pulled through one of the tubes of the heat exchanger.
Figure 11A:
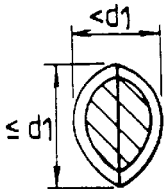
FIG. 11 is an axial elevation and a radial section through the second bullet assembly in a collapsed state; and, FIG. 12 an axial section through a third bullet assembly in a collapsed state.

FIGS. 8 and 9 illustrate the typical use of this apparatus. A heat exchanger 63 includes a plurality of tubes 65 which are held in position by cross fins 67. In use the tubes are loosely arranged in the fins 67. The diameter of the tubes 65 at this stage are $d_3$. A bullet assembly is then moved to the end of the tube 65 in its collapsed condition. In this condition the diameter of the bullet assembly is $d_3$ so that the bullet assembly will not contact the tube walls 65 during this stroke. The bullet assembly is then pulled through the tubes 65 and therefore is in their expanded condition thus expanding the tube diameter to $d_2$.

It will be appreciated that in this condition each bearing plate will have a plurality of stems of bullet assemblies mounted thereon, movement of the housing 35 effecting movement of all of the bullet assemblies.

Figure 10A:
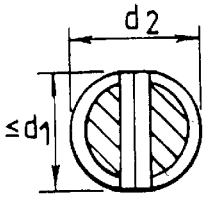
FIG. 10 is an axial elevation and a radial section through a second bullet assembly in an expanded state.
Figure 10:
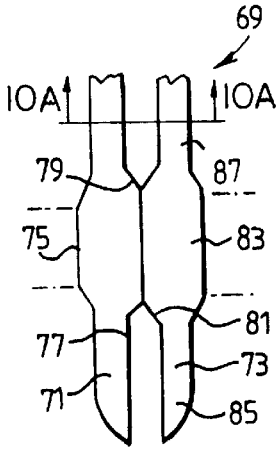
Figure 11:
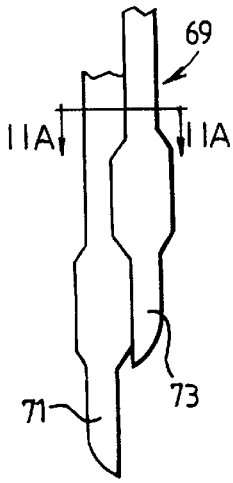
Figure 12:
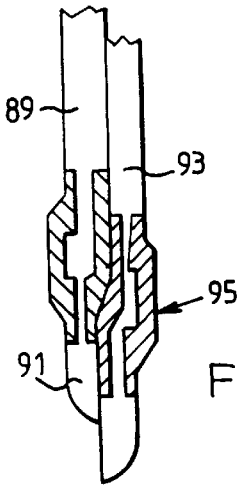

The second example of a bullet assembly 69 is illustrated in FIGS. 10 to 12, which assembly comprises two bullet segments 71 and 73 which have a similar outer surface 75 and inner surface 77. The outer surfaces 75 are arcuate and the bullet segment has a radial cross section which is a secant, not equal to a semicircle.

The inner surfaces include complementary tapers 79 and 81. Each bullet segment includes a body region 83 of larger cross section than head region 85 and tail region 87 between which it lies. When the body regions 83 are aligned the maximum diameter in at least one direction occupied by the bullet assembly is $d_2$.

When the bullet segments are slid relative to one another and the inner tapers 79 and 81 are in contact as shown in FIG. 11 the body assembly is in a collapsed state with an overall maximum dimension of $d_3$ which is less than $d_1$.

The first and second bullet assemblies comprise bullet segments of a one piece construction of a hard metal such as steel. The third bullet assembly 89 comprises bullet segments 91 which have a steel head and tail (and Stem) 93 and a ceramic body region 95 which resists friction. Also the ceramic is easy to manufacture in the fine shapes required of the bullet segments, both in the region of the body outer surface which bears against the tube and the inner surfaces especially at the tapers where the bullet segments bear against each other.

Various other modifications and alterations to the present invention will no doubt occur to those skilled in the art. It is the following claims, including equivalents, which define the scope of the present invention.

What is claimed is:

1. An apparatus for expanding a tube from a first diameter to a second diameter by passing a mandrel through a tube, comprising:

a bullet assembly comprising at least two co-operating bullet segments, each bullet segment having an outer surface for contacting an inner surface of the tube and an inner surface for contacting an inner surface of an adjacent bullet segment, the outer surface of each segment being generally arcuate in radial cross-section and each bullet segment having a body region between a head and tail region, each of the head and tail regions being of smaller cross-section than the cross-section of the body region, the inner surfaces of adjacent bullet segments having co-operating tapered surfaces shaped such that the bullet segments are movable axially with respect to one another from an expanded state to a collapsed state, such that in said expanded state, said bullet segments lay with their body regions aligned, the body regions together defining a circle of diameter equal to the second diameter, and in said collapsed state, the body regions of the bullet segments are non-aligned whereby the diameter of the bullet assembly throughout its length is less than the first diameter; and means for axially sliding the bullet segments one with respect to another such that as the bullet assembly is pushed into the tube, the bullet segments are in a collapsed state and as the bullet assembly is pulled out of the tube the bullet segments are slid axially one with respect to another into their expanded state such that pulling the bullet assembly through the tube expands its diameter to the second diameter.

2. Apparatus according to claim 1, including a plurality of bullet assemblies arranged to expand a plurality of tubes simultaneously.

3. Apparatus according to claim 1, in which the head region of each bullet segment is rounded.

4. Apparatus according claim 1, wherein the bullet segments have mutually substantially identical outer surfaces.

5. Apparatus according to claim 1, wherein the bullet assembly comprises three bullet segments.

6. Apparatus according to claim 1, wherein said means for axially sliding to move the bullet segments with respect to each other includes a plurality of pressure bearing plates, each plate being secured to a remote end of a stem of a bullet segment so that the plate lies substantially perpendicular to the stem, the bearing plates being mounted within a housing including a series of shoulders arranged such that when pressure is applied to the housing to push the bullet assembly in a direction into the tube, the plates are kept apart to collapse the bullet and when the housing is moved in an opposite direction and the bullet assembly is pulled, the plates are moved together thus axially moving the bullet segments with respect to one another to move the bullet assembly into its expanded state.

* * * * *